United States Patent [19]

Umesaki et al.

[11] Patent Number: 4,572,143

[45] Date of Patent: Feb. 25, 1986

[54] APPARATUS FOR DETECTING AND INDICATING ABNORMALITY IN AN ELECTRONIC CONTROL SYSTEM FOR INTERNAL COMBUSTION ENGINES

[75] Inventors: Shigeo Umesaki, Iruma; Shumpei Hasegawa, Niiza, both of Japan

[73] Assignee: Honda Giken Kogyo K.K., Tokyo, Japan

[21] Appl. No.: 703,815

[22] Filed: Feb. 21, 1985

[30] Foreign Application Priority Data

Feb. 24, 1984 [JP] Japan ..... 59-33805

[51] Int. Cl.[4] ..... F02B 3/00

[52] U.S. Cl. ..... 123/479

[58] Field of Search ..... 123/479, 623

[56] References Cited

U.S. PATENT DOCUMENTS 4,370,962 2/1983 Hosaka ..... 123/479
4,393,842 7/1983 Otsuka ..... 123/479
4,531,190 7/1985 Drews ..... 123/479

FOREIGN PATENT DOCUMENTS 2104247 3/1983 United Kingdom ..... 123/479

*Primary Examiner*—Ronald B. Cox
*Attorney, Agent, or Firm*—Arthur L. Lessler

[57] ABSTRACT

An apparatus for detecting and indicating abnormality in an electronic control system for an internal combustion engine, which system includes an operation control unit operable on a supply voltage from a first power source to supply a plurality of output means with operation control signals dependent on the values of parameter signals detected by a plurality of input means. A plurality of abnormality detecting circuits detect abnormality in the operation of respective ones of the input and output means, and generate abnormality-indicative signals when abnormality is detected. A memory stores data of the abnormality-indicative signal supplied from the abnormality detecting circuits. Abnormality indicating circuit indicates the data stored in the memory. The memory is operable on a supply voltage from a second power source, and adapted to erase the data stored therein when it starts to be supplied with a supply voltage from the second power source.

10 Claims, 2 Drawing Figures

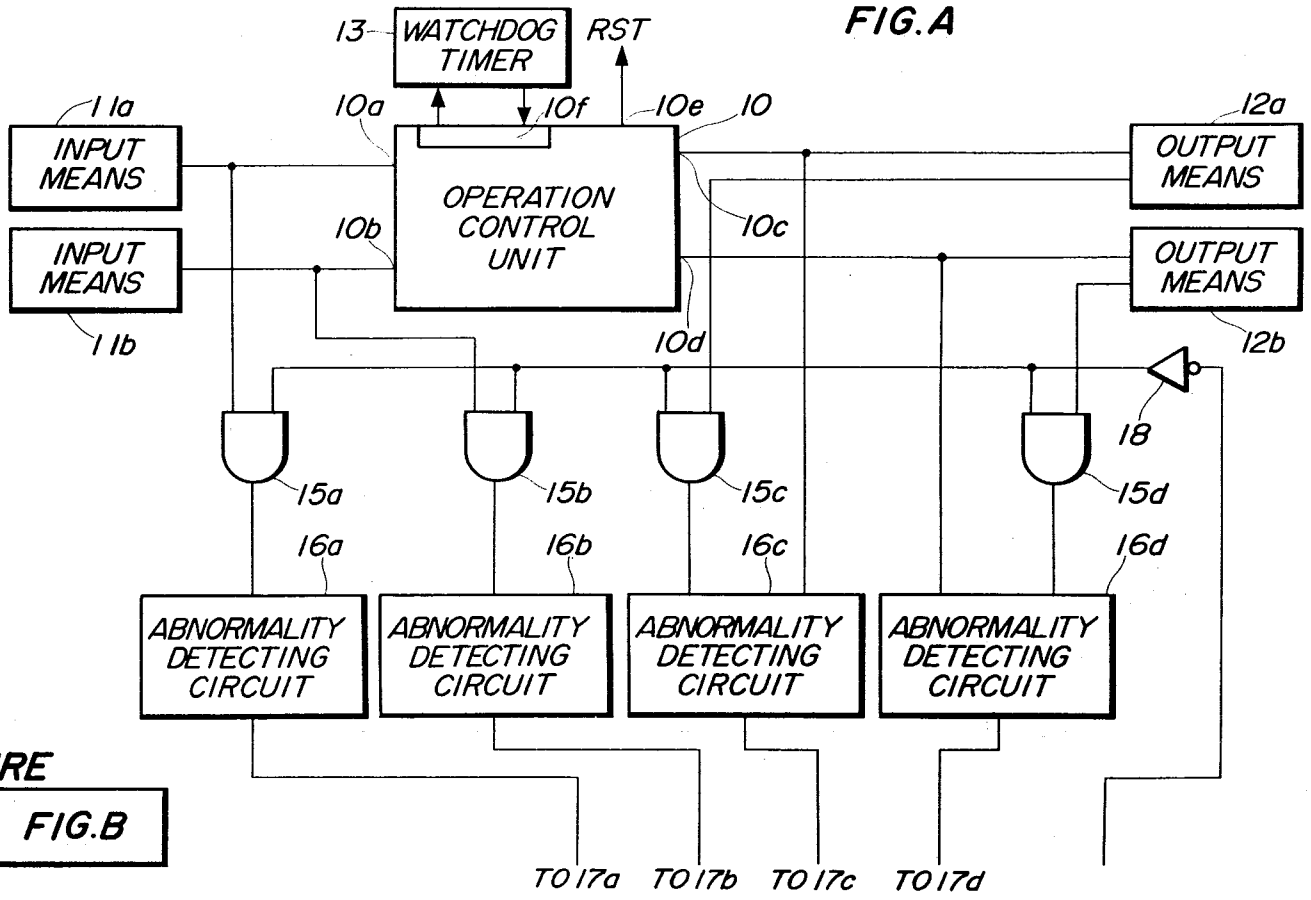
FIG.A
FIGURE
| FIG.A | FIG.B |
|---|---|

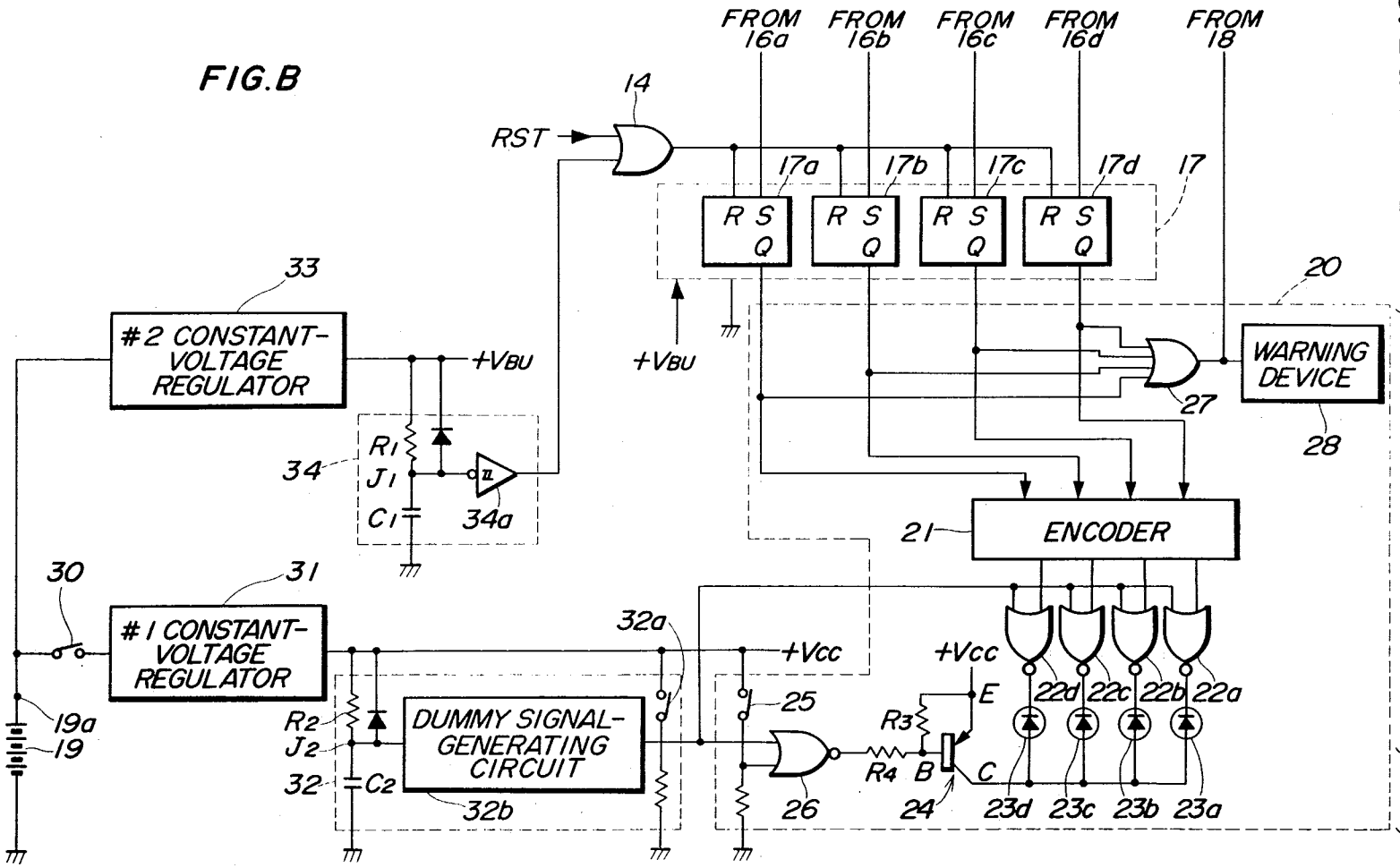
FIG. B

APPARATUS FOR DETECTING AND INDICATING ABNORMALITY IN AN ELECTRONIC CONTROL SYSTEM FOR INTERNAL COMBUSTION ENGINES

BACKGROUND OF THE INVENTION

This invention relates to an apparatus for detecting and indicating abnormality in an electronic control system for internal combustion engines, and more particularly to an apparatus of this kind which ensures easy identification of the place where abnormality exists when any one of input and output means of the electronic control system is in an abnormal state.

An electronic control system for an internal combustion engine, for instance, an electronic fuel supply control system for electronically controlling the amount of fuel to be supplied to the engine is generally adapted to detect the values of various parameters indicative of operating conditions of the engine, and control the operation of various output means such as a fuel pump and fuel injection valves, on the basis of the detected values of the various engine operation parameters. Conventionally, when abnormality occurs in such electronic control system equipped with various input and output means, to identify or find out the place where such abnormality exists it is generally employed to determine input and output means to be inspected, depending upon the operating condition in which the engine was operating upon occurrence of the abnormality, and upon the intuition of the serviceman, and inspect those means one by one. However, such checking manner requires a great deal of efforts as well as a lot of time to find out the place where abnormality is present. Particularly, abnormality due to bad connections and short circuits cannot be reproduced in a static condition where the engine is in a standing position, making it impossible to find out the abnormality location. Further, there are some abnormalities which cannot be immediately recognized by the driver, even though they badly affect the emission characteristics, fuel consumption, etc. Upon occurrence of such abnormalities, proper measures cannot be taken immediately.

SUMMARY OF THE INVENTION

It is the object of the invention to provide an abnormality detecting indicating apparatus for an electronic control system of an internal combustion engine, which can indicate abnormality and identify the location of the abnormality immediately upon occurrence of abnormality in any one of the input and output means, to thereby facilitate the repair operation.

The invention provides an apparatus for detecting and indicating abnormality in an electronic control system for an internal combustion engine, including a plurality of input means adapted to detect values of parameters indicative of operating conditions of the engine and generate signals indicative of the detected parameter values, a plurality of output means, a first power source, and control means operable on a supply voltage from the first power source to supply the output means with operation control signals dependent on the detected values of the parameter signals. A plurality of abnormality detecting means are adapted to detect abnormality in the operation of respective ones of the input means and output means, and generate abnormality-indicative signals when abnormality is detected. Memory means stores data of an abnormality-indicative signal supplied from any of the abnormality detecting means that has detected abnormality. Abnormality indicating means indicates the data stored in the memory means. The memory means is operable on a supply voltage from a second power source. The memory means is adapted to erase the data stored therein when it starts to be supplied with the supply voltage from the second power source.

Preferably, the abnormality indicating means comprises at least one bit binary code indicating means for indicating the data stored in the memory means in binary code. Further preferably, the abnormality indicating means includes switch means and is adapted to indicate the data stored in the memory means when the switch means is closed.

Preferably, the memory means is adapted to erase the data stored therein when the control means recovers a normal state wherein it carries out a predetermined operation within a predetermined period of time, from an abnormal state wherein it does not carry out the predetermined operation within the predetermined period of time. Further preferably, means is provided for rendering inoperative all the abnormality detecting means other than one which has detected abnormality.

Still preferably, the abnormality detecting indicating apparatus according to the invention includes first dummy signal-generating means adapted to generate a dummy signal having a predetermined voltage level through human operation, and supply same to the abnormality indicating means as a signal indicative of data equivalent to particular data to be stored in the memory means.

Preferably, the electronic control system includes switch means interposed between the first power source and the control means. The abnormality detecting indicating apparatus according to the invention includes second dummy signal-generating means adapted to generate a dummy signal having a predetermined voltage level and supply same to the abnormality indicating means as a signal indicative of data equivalent to particular data to be stored in the memory means, for a predetermined period of time after the switch means is closed.

The above and other objects, features and advantages of the invention will be more apparent from the ensuing detailed description taken in conjunction with the accompanying drawing.

BRIEF DESCRIPTION OF THE DRAWING

The FIGS. A & B are a circuit diagram illustrating the circuit configuration of an abnormality detecting indicating apparatus according to an embodiment of the invention.

DETAILED DESCRIPTION

The invention will now be described in detail with reference to the drawing showing an abnormality detecting indicating apparatus according to the invention which is applied, by way of example, to an electronic fuel supply control system for an internal combustion engine.

In the figure, reference numeral 10 designates an operation control unit, which has a plurality of input terminals 10*a*, 10*b* connected, respectively, to a plurality of input means 11*a*, 11*b*. The input means 11*a*, 11*b* may include engine operation parameter sensors alone for detecting values of parameters indicative of operating conditions of the engine, such as engine rotational speed, intake air quantity, engine cooling water temperature, and exhaust gas concentration, or they may include, in combination with these engine operation parameter sensors or singly, a level shifter for shifting the voltage levels of output signals from the sensors to a predetermined voltage level, an analog-to-digital (A/D) converter for converting analog output signals from the sensors to corresponding digital signals, etc. The operation control unit 10 is connected at its output terminals 10*c*, 10*d* to a plurality of output means 12*a*, 12*b* such as fuel injection valves provided at respective cylinders of the engine, none of which is shown, and a fuel pump, not shown. In the figure, only two input means and two output means are shown for the convenience of explanation. The operation control unit 10 is further connected at its input/output port 10*f* to a watchdog timer 13, and at its output terminal 10*e* to the input of an OR gate 14, respectively.

The input means 11*a*, 11*b* and the output means 12*a*, 12*b* are also connected at their outputs, respectively, to inputs of abnormality detecting circuits 16*a*–16*d* via AND gates 15*a*–15*d*. The operation control unit 10 has its output terminals 10*c* and 10*d* also connected to the inputs of the abnormality detecting circuits 16*c* and 16*d*, respectively. The abnormality detecting circuits 16*a*–16*d* are connected at their outputs to set pulse inputs of a random access memory (hereinafter called "the RAM") 17 which is formed of a plurality of flip-flop circuits 17*a*–17*d* connected, respectively, to the abnormality detecting circuits 16*a*–16*d* in this embodiment. The outputs of the flip-flop circuits 17*a*–17*d* are connected to inputs of an abnormality indicating circuit 20. The output of the abnormality indicating circuit 20 is connected to the inputs of the AND gates 15*a*–15*d* via an inverter 18.

A battery 19 is connected via an ignition switch 30 of the engine to a first constant-voltage regulated power supply 31 which in turn is connected at its output to a dummy signal-generating circuit 32. The output of the dummy signal-generating circuit 32 is connected to an input of the abnormality indicating circuit 20. The battery 19 is also connected to a second constant-voltage regulated power supply 33, the output of which is connected to the input of an initializing reset signal-generating circuit 34. The reset signal-generating circuit 34 is connected at its output to an input of the OR gate 14 which has its output connected to reset pulse inputs of the RAM 17.

The electronic fuel supply control system and the abnormality detecting indicating apparatus constructed as above, operate as follows:

When the ignition switch 30 is closed or turned on, a constant voltage VCC, e.g. 5 volts, is built up at the output of the first constant-voltage regulated power supply 31, which is supplied to the circuit components other than at least the OR gate 14 and the RAM 17. The OR gate 14 and the RAM 17 are supplied with a constant voltage VBU which is produced at the output of the second constant-voltage regulated power supply 33, as hereinafter referred to.

Various engine operation parameter signals from the input means 11*a*, 11*b* are supplied to the operation control unit 10 as well as to the respective abnormality detecting circuits 16*a*, 16*b* through the AND gates 15*a*, 15*b* when they are energized. The operation control unit 10 determines operating conditions of the engine on the basis of values of these various engine operation parameter signals, and then calculates control amounts for controlling the output means 12*a*, 12*b* such as the fuel injection valves and the fuel pump, in accordance with the determined operating conditions of the engine. Control signals corresponding to the calculated control amounts are supplied to the output means 12*a*, 12*b* for driving same, as well as to the abnormality detecting circuits 16*c*, 16*d*, as hereinafter referred to.

The output means 12*a*, 12*b* generate signals indicative of their respective operative states, e.g. signals indicative of whether or not the solenoids of the fuel injection valves are energized to open their valve bodies, none of which is shown, and supply same to the abnormality detecting circuits 16*c*, 16*d* through the AND gates 15*c*, 15*d*.

The watchdog timer 13 determines whether or not a control program is properly executed within the operation control unit 10 in a predetermined sequence. For instance, the timer 13 is driven by a driving signal which is generated by the operation control unit 10 each time the unit 10 completes execution of a predetermined action in accordance with the control program, to determine that the operation control unit 10 malfunctions or is overrunning when the timer is not supplied with the driving signal at all within a predetermined period of time. When the operation control unit 10 is determined to malfunction, the watchdog timer 13 supplies a signal having a high level of 1 to the operation control unit 10 to cause it to interrupt calculation of various control amounts executed therein and effect necessary correcting actions, e.g. initialization of the control program. At the same time, the operation control unit 10 supplies a reset pulse signal to the RAM 17 through the OR gate 14, to erase data stored in the RAM 17. This is to avoid the phenomenon that abnormal control signals generated by the malfunctioning operation control unit 10 are supplied to the output means 12*a*, 12*b* so that the abnormality detecting circuits 16*c*, 16*d* judge the output means 12*a*, 12*b* to be abnormal per se, and accordingly memorize failure code into the RAM 17 to indicate abnormality through the abnormality indicating circuit 20.

The abnormality detecting circuits 16*a*–16*d* sense abnormality in the values of signals supplied from respective ones of the input and output means 11*a*, 11*b*, 12*a* and 12*b*. Various manners may be applied for sensing abnormality by these abnormality detecting circuits 16*a*–16*d*. For instance, the circuits 16*a*, 16*b* for sensing abnormality in the input means 11*a*, 11*b*, respectively, may be adapted to judge that the associated input means is in an abnormal state when the signal from the input means shows a value falling outside a range defined by predetermined upper and lower limits to be assumed when the same input means is in a normal state. The abnormality detecting circuits 16*c*, 16*d*, which sense abnormality in the output means 12*a*, 12*b*, respectively, may be adapted to compare the values of control signals supplied to the respective output means from the operation control unit 10, with values of operative state-indicative signals supplied from the respective output means, and judge that the associated output means is in an abnormal state when the result of the comparison between these signal values does not fulfill a predetermined relationship.

When any one of the abnormality detecting circuits 16*a*–16*d* senses abnormality, it supplies a signal having a high level of 1 to the RAM 17 as an abnormality-indicative signal.

The operation of the RAM 17 which is formed of flip-flops 17*a*–17*d* corresponding in number to the abnormality detecting circuits 16*a*–16*d* is as follows. For instance, if the abnormality detecting circuit 16*a* generates an abnormality-indicative signal, the same signal is applied to input terminal S of the flip-flop 17*a* which then generates a signal having a high level of 1 at its output terminal Q and applies same to the abnormality indicating circuit 20. The RAM 17 is supplied with the constant supply voltage VBU from the second constant-voltage regulated power supply 33. Therefore, even when the ignition switch 30 is opened or turned off, the RAM 17 retains its data until a reset pulse signal is applied to reset terminals of the flip-flops 17*a*–17*d*.

At least the RAM 17 and the OR gate 14 may be formed by a C-MOS for example, so that they can be operated on a predetermined supply voltage lower than the constant voltage VCC (=5 volts) produced by the first constant voltage regulated power supply 31, 3 volts for instance. Thus, even when the starter, not shown, of the engine is repeatedly operated to cause a drop in the output voltage of the battery 19 in cold weather, etc., the phenomenon can be avoided that the data stored in the RAM 17 is erased due to the resulting drop in the supply voltage VBU for the RAM 17.

The flip-flops 17*a*–17*d* are reset by the reset pulse signal RST generated by the operation control unit 10 when it malfunctions, as well as by the initializing reset pulse signal generated by the initializing reset signal-generating circuit 34. The initializing reset pulse signal is generated only once when the output terminal 19*a* of the battery 19 is connected to the circuit of the figure to supply an output voltage from the battery 19 to the second constant-voltage regulated power supply 33, at a service station, etc. The output voltage from the battery 19 is regulated to the constant voltage VBU by the second constant-voltage regulated power supply 33 and supplied to a series circuit formed by a resistance R1 and a capacitor C1 of the initializing reset signal-generating circuit 34. A voltage produced at the junction J1 of the resistance R1 with the capacitor C1 reaches a peak level after the lapse of a predetermined period of time determined by the time constant of the resistance R1 and the capacitor C1. Until the voltage at the junction J1 reaches its peak voltage after the connection of the battery terminal 19*a* to the circuit 34, an inverter 34*a* continually generates a signal having a high level of 1, i.e. the initializing reset pulse signal, which is supplied via the OR gate 14 to the flip-flops 17*a*–17*d* to reset same. Thus, the flip-flops 17*a*–17*d* are reset by the initializing reset pulse signal generated only at the time of connection of the battery terminal 19*a* to the circuit.

The output signals from the flip-flops 17*a*–17*d* are supplied to an encoder 21 of the abnormality indicating circuit 20. The encoder 21 is connected at its output to inputs of a plurality of, e.g. four NOR gates 22*a*–22*d*. When a high-level signal is applied to the encoder 21 from any one of the flip-flops 17*a*–17*d*, the encoder 21 supplies a 4-bit signal to the NOR gates 22*a*–22*d*, which corresponds to the flip-flop from which the high-level signal is supplied. More specifically, when none of the flip-flops 17*a*–17*d* generates a high-level signal, that is, when none of the input means 11*a*, 11*b* and the output means 12*a*, 12*b* are determined to be in an abnormal state, the encoder 21 generates low-level signals and applies same to the NOR gates 22*a*–22*d*. On the other hand, when abnormality occurs in the input means 11*a*, for instance, that is, when the flip-flop 17*a* generates a high-level signal, the encoder 21 supplies a high-level signal to the NOR gate 22*a* alone. When the output means 12*a* is determined to be in an abnormal state, that is, when the flip-flop 17*c* generates a high-level signal, both the NOR gates 22*a* and 22*b* are supplied with a high-level signal from the encoder 21, for instance. That is, the encoder 21 supplies the high-level signal to one or more of the NOR gates 22*a*–22*d*, in a predetermined manner depending on the place where abnormality occurs.

The NOR gates 22*a*–22*d* are connected at their outputs to the collector C of a PNP transistor 24 via respective light emission diodes 23*a*–23*d*. The emitter E of the transistor 24 is connected to the first constant-voltage regulated power supply 31 to be supplied with the constant supply voltage VCC, and also connected to an output of a NOR gate 26 via resistances R3 and R4 connected in series, the junction between the resistances R3 and R4 being connected to the base B of the transistor 24. The NOR gate 26 has an input connected to the output of the first constant-voltage regulated power supply 31 via a switch 25.

When the switch 25 of the abnormality indicating circuit 20 is closed or turned on, the constant voltage VCC is supplied from the first constant-voltage regulated power supply 31 to the NOR gate 26 to cause inversion of the output of the NOR gate 26 to a low level, to cause a predetermined voltage difference between the emitter E and the base B of the transistor 24, making the transistor 24 conduct.

If on this occasion the NOR gates 22*a* and 22*b* are supplied with high-level signals from the encoder 21, for instance, they generate output signals having a low level so that a predetermined voltage difference is produced between the outputs of the NOR gates 22*a*, 22*b* and the collector C of the transistor 24, to cause the light emission diodes 23*a* and 23*b* to emit light. Thus, by closing the switch 25 of the abnormality indicating circuit 20 at desired time, one or more of the light emission diodes 23*a*–23*d* corresponding to the abnormality location in the system are energized to emit light, thereby facilitating identification of the abnormality location. If four light emission diodes are used to indicate abnormality as in the embodiment of the invention, the circuit 20 can discriminate $(2^4-1)$ or fifteen abnormality locations among the input and output means. The number of the light emission diodes to be employed may optionally be increased or decreased.

When any one of the flip-flops 17*a*–17*d* generates a high-level signal, the high-level signal is also applied via an OR gate 27 to a warning device 28 to actuate same. For instance, the warning device 28 may be adapted to light an alarm lamp to indicate abnormality location among the input and output means.

The high-level signal supplied from any one of the flip-flops 17*a*–17*d* via the OR gate 27 is inverted to a low-level signal by an inverter 18, which is then applied to the AND gates 15*a*–15*d* to deenergize all of them. That is, when abnormality is detected in any one of the input and output means, the abnormality detecting function is interrupted even if abnormality occurs in another one of the input and output means at the same time. This is because the light emission diodes 23*a*–23*d* can indicate only one place where abnormality occurs at one time, and therefore, the encoder 21 should not be supplied at the same time with two or more high-level signals indicating abnormality in two or more input and output means.

Reference is now made to the operation of the dummy signal-generating means 32. The means 32 comprises a parallel circuit formed by a switch 32*a* and a dummy signal-generating circuit 32*b*. When the switch 32*a* is closed or turned on, the constant voltage VCC is supplied from the first constant-voltage regulated power supply 31 to the NOR gates 22*a*–22*d* and the NOR gate 26 of the abnormality indicating circuit 20 so that the outputs of these NOR gates 22*a*–22*d* and 26 are inverted to the low level to cause the transistor 24 to conduct, in the same manner as caused by closing of the switch 25. If no abnormality is present in any of the NOR gate 26, the transistor 24, the light emission diodes 23*a*–23*d*, the NOR gates 22*a*–22*d*, and the wiring connecting between these elements, the light emission diodes 23*a*–23*d* are all energized to emit light by closing the switch 32*a*, making it possible to ascertain that no abnormality exists in the abnormality indicating circuit 20 inclusive of the light emission diodes 23*a*–23*d*, just by watching the light emission state of the diodes.

The dummy signal-generating circuit 32*b* is adapted to generate a signal at a high level of 1, i.e. the constant voltage VCC, only once when the ignition switch 30 is closed or turned on, for a predetermined period of time in the same manner as when the switch 32*a* is closed, to thereby permit checking the function of the circuit 20 including the light emission diodes 23*a*–23*d*. To this end, the input of the dummy signal-generating circuit 32*b* is connected via a resistance R2 to the first constant-voltage regulated power supply 31 and also grounded through a capacitor C2. When the ignition switch 30 is closed, the output voltage from the battery 19, regulated to the constant voltage VCC by the first constant-voltage regulated power supply 31, is supplied to the series circuit of the resistance R2 and the capacitor C2 so that the circuit 32*b* generates a high-level signal for the above-mentioned predetermined period of time, e.g. 10 seconds, after a voltage produced at the junction J2 of the resistance R2 with the capacitor C2 has reached a predetermined level upon the lapse of a time period determined by the time constant of the resistance R2 and the capacitor C2. This high-level signal is supplied to the NOR gates 22*a*–22*d* and 26 of the abnormality indicating circuit 20. By thus causing the circuit 32*b* to generate a high-level signal for the predetermined period of time, it is possible to check the functioning of the abnormality indicating circuit 20 from the light emission state of the light emission diodes 23*a*–23*d* which should all be energized to emit light if they have no abnormality.

Although the illustrated embodiment is arranged such that the high-level signal generated by closing the switch 32*a* of the dummy signal-generating circuit 32 and the high-level signal generated by the dummy signal-generating circuit 32*b* by closing the ignition switch 30 are applied to the inputs of the NOR gates 22*a*–22*d*, such high-level signals may alternatively be applied to a predetermined input terminal of the encoder 21 so that the encoder 21, the OR gate 27 and the warning device 28 can also have their functioning checked.

Further, the abnormality detecting indicating apparatus according to the invention may alternatively be applied to other systems than electronic fuel supply control systems as in the foregoing embodiment, such as a spark ignition timing control system and an exhaust gas recirculation-control system.

What is claimed is:

1. An apparatus for detecting and indicating abnormality in an electronic control system for an internal combustion engine, including a plurality of input means adapted to detect values of parameters indicative of operating conditions of said engine and generate signals indicative of the detected parameter values, a plurality of output means, a first power source, and control means operable on a supply voltage from said first power source to supply said output means with operation control signals dependent on the detected values of said parameter signals, said apparatus comprising:

a plurality of abnormality detecting means adapted to detect abnormality in the operation of respective ones of said input means and said output means, and generate abnormality-indicative signals when abnormality is detected;

memory means for storing data of said abnormality-indicative signal supplied from any of said abnormality detecting means that has detected abnormality;

abnormality indicating means for indicating the data stored in said memory means; and a second power source;

wherein said memory means is operable on a supply voltage from said second power source, said memory means being adapted to erase the data stored therein when it starts to be supplied with said supply voltage from said second power source.

2. An apparatus as claimed in claim 1, wherein said abnormality indicating means comprises at least one bit binary code indicating means for indicating the data stored in said memory means in binary code.

3. An apparatus as claimed in claim 1, wherein said abnormality indicating means includes switch means and is adapted to indicate the data stored in said memory means when said switch means is closed.

4. An apparatus as claimed in claim 1, wherein said memory means is adapted to erase the data stored therein when said control means recovers a normal state wherein it carries out a predetermined operation within a predetermined period of time, from an abnormal state wherein it does not carry out said predetermined operation within said predetermined period of time.

5. An apparatus as claimed in claim 1, including means for rendering inoperative all said abnormality detecting means other than one which has detected abnormality.

6. An apparatus as claimed in claim 1, wherein said abnormality indicating means includes warning means for giving a warning when abnormality is detected in at least one of said input means and said output means.

7. An apparatus as claimed in claim 1, further including first dummy signal-generating means adapted to generate a dummy signal having a predetermined voltage level through human operation, and supply same to said abnormality indicating means as a signal indicative of data equivalent to particular data to be stored in said memory means.

8. An apparatus as claimed in claim 1, wherein said electronic control system includes switch means interposed between said first power source and said control means, said apparatus including second dummy signal-generating means adapted to generate a dummy signal having a predetermined voltage level and supply same to said abnormality indicating means as a signal indicative of data equivalent to particular data to be stored in said memory means, for a predetermined period of time after said switch means is closed.

9. An apparatus as claimed in claim 1, wherein said output means include means for supplying fuel to said engine.

10. An apparatus as claimed in claim 1, wherein said output means include ignition means for igniting an air/fuel mixture supplied to said engine.

* * * * *